US008182210B2

(12) United States Patent
Khanin et al.

(10) Patent No.: US 8,182,210 B2
(45) Date of Patent: May 22, 2012

(54) HEAT SHIELD SEGMENT FOR A STATOR OF A GAS TURBINE

(75) Inventors: Alexander Khanin, Moscow (RU); Igor Kurganov, Samara (RU); Sergey Vorontsov, Moscow (RU); Anatoly Shunin, Moscow (RU)

(73) Assignee: ALSTOM Technology Ltd, Baden (CH)

( * ) Notice: Subject to any disclaimer, the term of this patent is extended or adjusted under 35 U.S.C. 154(b) by 169 days.

(21) Appl. No.: 12/645,880

(22) Filed: Dec. 23, 2009

(65) Prior Publication Data

US 2010/0150712 A1 Jun. 17, 2010

Related U.S. Application Data

(63) Continuation of application No. PCT/EP2008/057946, filed on Jun. 23, 2008.

(30) Foreign Application Priority Data

Jun. 28, 2007 (CH) ..... 1043/07

(51) Int. Cl.
*F04D 29/58* (2006.01)

(52) U.S. Cl. ..... 415/173.1

(58) Field of Classification Search ..... 415/173.1
See application file for complete search history.

(56) References Cited

U.S. PATENT DOCUMENTS

| | | | | |
|---|---|---|---|---|
| 3,365,173 | A | 1/1968 | Lynch et al. | |
| 4,987,736 | A | 1/1991 | Ciokajlo et al. | |
| 5,380,150 | A | 1/1995 | Stahl | |
| 6,361,273 | B1 * | 3/2002 | Eng et al. | 415/173.1 |
| 6,502,622 | B2 * | 1/2003 | Lee et al. | 164/35 |
| 6,508,623 | B1 * | 1/2003 | Shiozaki et al. | 415/173.1 |
| 6,602,048 | B2 * | 8/2003 | Fujikawa et al. | 415/116 |
| 6,779,597 | B2 * | 8/2004 | DeMarche et al. | 165/169 |
| 2001/0019695 | A1 | 9/2001 | Correia | |
| 2002/0098079 | A1 | 7/2002 | Fujikawa et al. | |
| 2010/0251721 | A1 * | 10/2010 | Morrison et al. | 60/753 |

FOREIGN PATENT DOCUMENTS

| | | | |
|---|---|---|---|
| DE | 102005013798 | A1 | 9/2006 |
| EP | 1096108 | A2 | 5/2001 |
| EP | 1225305 | A2 | 7/2002 |
| GB | 2226086 | A | 6/1990 |

OTHER PUBLICATIONS

International Search Report mailed Oct. 30, 2008, which issued during prosecution of International Patent Application No. PCT/EP2008/057946.

* cited by examiner

*Primary Examiner* — Edward Look
*Assistant Examiner* — Liam McDowell
(74) *Attorney, Agent, or Firm* — Leydig, Voit & Mayer, Ltd.

(57) ABSTRACT

A gas turbine includes a turbine housing; a rotatable turbine rotor with turbine blades; and at least one heat shield segment for a stator. The heat shield segment is disposed radially between the rotor and the housing and attached to the housing and has a profile with a curved section in at least one region in an axial direction of the gas turbine and a radial outer surface. The heat shield segment includes a rib, a first boss, and a second boss disposed on the radial outer surface.

14 Claims, 3 Drawing Sheets

A - A

HEAT SHIELD SEGMENT FOR A STATOR OF A GAS TURBINE

This application is a continuation of International Patent Application No. PCT/EP2008/057946, filed on Jun. 23, 2008, which claims priority to Swiss Patent Application No. CH 01043/07, filed on Jun. 28, 2007. The entire disclosure of both applications is incorporated by reference herein.

The present invention relates to a heat shield segment for a stator of a gas turbine engine.

BACKGROUND

The turbine rotor of a gas turbine engine is usually surrounded in the radial direction by a housing, which is generally known as a heat shield. The heat shield can comprise a number of heat shield segments, whereby the heat shield forms the outer limit of the hot gas flow along the turbine blades. The heat shield also prevents that hot combustion gases penetrate into the space between the heat shield and radially outer turbine housing filled with cooling air. The heat shield can have many different forms, and its inner profile defines the flow cross section of the hot gas flow in the turbine. The turbine blades of the turbine rotor usually have on their radially outer side a surrounding platform, which, depending on the required flow conditions, is either generally cylindrical or generally conical formed. The platform normally has two sealing ribs extending radially outwards from its radially outer side. Honeycomb structures are arranged on the heat shield respectively opposite to the sealing ribs. These honeycomb structures serve to seal the gap between the sealing ribs and the heat shield. The inner profile of the heat shield in a first section provided with the honeycomb structure runs parallel to the axial direction of the turbine. In a second section upstream of the first flat section the inner profile runs at an angle to the axial direction of the turbine. Because the heat shield is subjected to the high temperatures of the hot gas flow and to the high pressure gradient in the flow direction of the hot gases high stress concentrations can arise in the area of the curved section between the first and the second sections. These stresses can significantly reduce the durability of the heat shield.

SUMMARY OF THE INVENTION

The invention addresses these problems. The present invention aims to provide a heat shield segment for a stator of a gas turbine with an improved design which reduces the stresses in the curved area of the heat shield.

According to the invention the heat shield segment comprises in at least one area of the profile in the axial direction of the gas turbine a curved section, whereby a radially outer surface of the heat shield segment in the region of the curved section and in a first end region in the circumferential direction of the heat shield segment is provided with a boss extending in the circumferential direction of the gas turbine. In use, the stresses in the heat shield segment in the area of the curved section are reduced, and hence the durability of the heat shield is significantly increased.

In a preferred embodiment of the invention the length of the boss in the circumferential direction is less than a quarter of the total length of the heat shield segment in the circumferential direction. In this way sufficient strengthening is provided without the need to provide a rib which extends the length of the heat shield between its end areas. This avoids excess material usage so that the weight of the heat shield can be kept to a minimum.

The above and other aspects, features and advantages of the invention will become more apparent from the following description of certain preferred embodiments thereof, when taken in conjunction with the accompanying drawings.

BRIEF DESCRIPTION OF THE DRAWINGS

The invention is described referring to an embodiment depicted schematically in the drawings, and will be described with reference to the drawings in more details in the following.

The drawings show schematically in.

DETAILED DESCRIPTION

Figure 3:
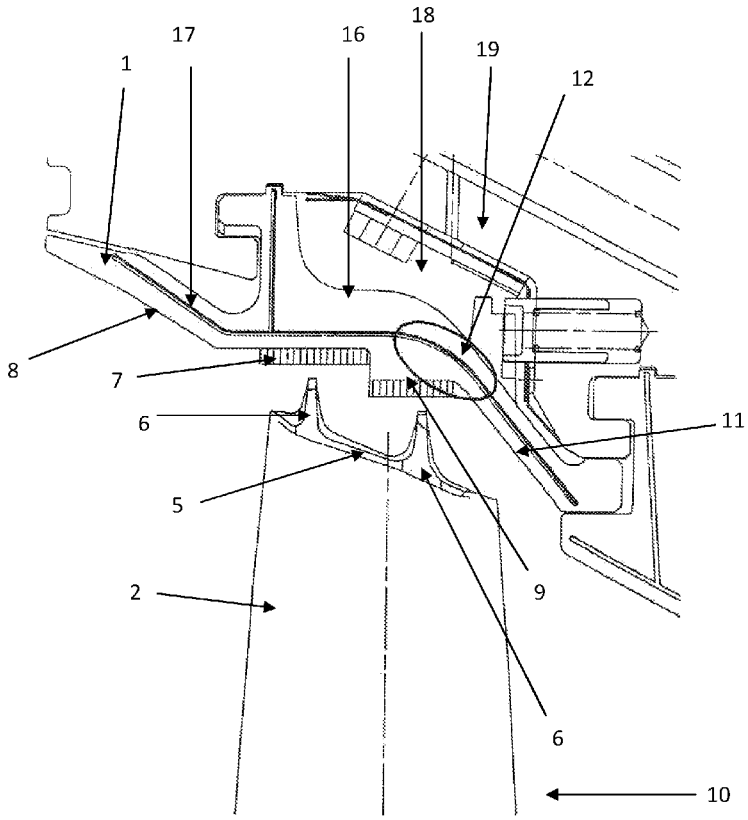
Prior art Fig. 3
Figure 4:
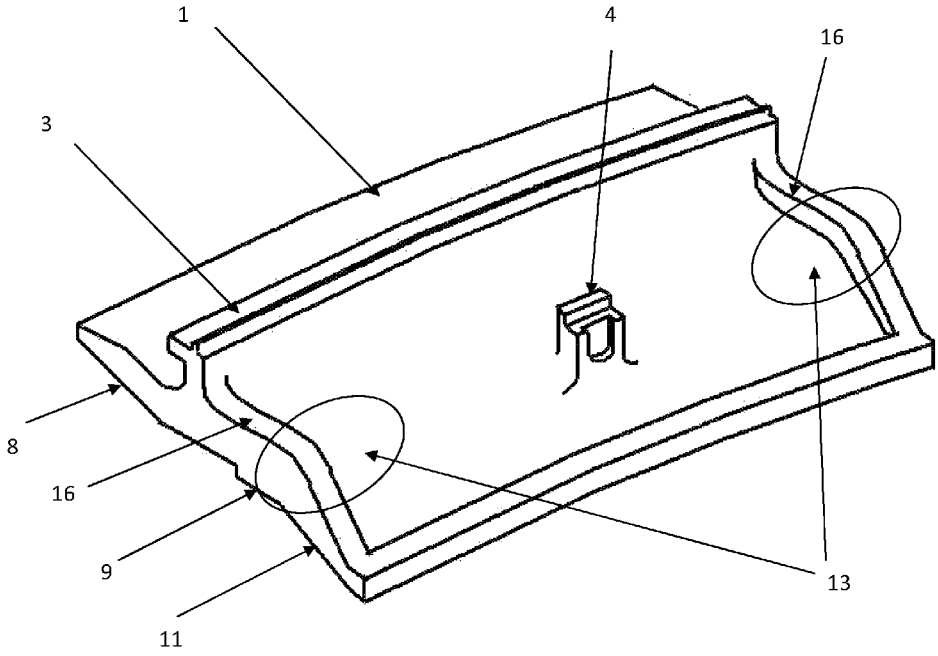
Prior art Fig. 4

FIG. 4 shows a prior art heat shield segment 1. A heat shield can comprise a number of such heat shield segments 1 which form an outer limit of a hot gas flow along the turbine blades 2 (cf. FIG. 3). The profile of the heat shield segment 1 matches to the generally conical form of a turbine rotor and has a stepped cross section, which can be seen in FIG. 3. Attachment elements 3, 4 are arranged on the radially outer side of the heat shield segment for positioning the heat shield segment 1 in the radial and circumferential directions.

FIG. 3 shows a cross section through a turbine portion with a prior art heat shield. The turbine blades 2 of the turbine rotor have a radially outer cylindrical platform 5 surrounding the blades 2. On the radially outer side of the platform 5 two radially extending ribs 6 are provided. Honeycomb structures 7 are fixed to the stationary heat shield segment 1 opposite to the two ribs 6 respectively. These honeycomb structures 7 serve to seal the gap between the ends of the ribs 6 and the heat shield segment 1. The inner profile 8 of the heat shield extends in a first section 9 substantially parallel to the axial direction of turbine. Upstream of the first flat section 9 the inner profile 8 of the heat shield segment 1 extends in a second section 11 at an angle to the axial direction of the turbine, whereby the flow direction of the hot gases is shown with arrow 10. As the heat shield segment 1 is subjected to the high temperatures of the hot gas flow and to the high pressure gradient in the flow direction high stresses can arise in the curved area 12 of the heat shield segment 1 between the first section 9 and the second section 11 and in particular in the end regions 13 of the heat shield in the circumferential direction. These stresses can limit the life of the heat shield segment significantly.

Figure 1:
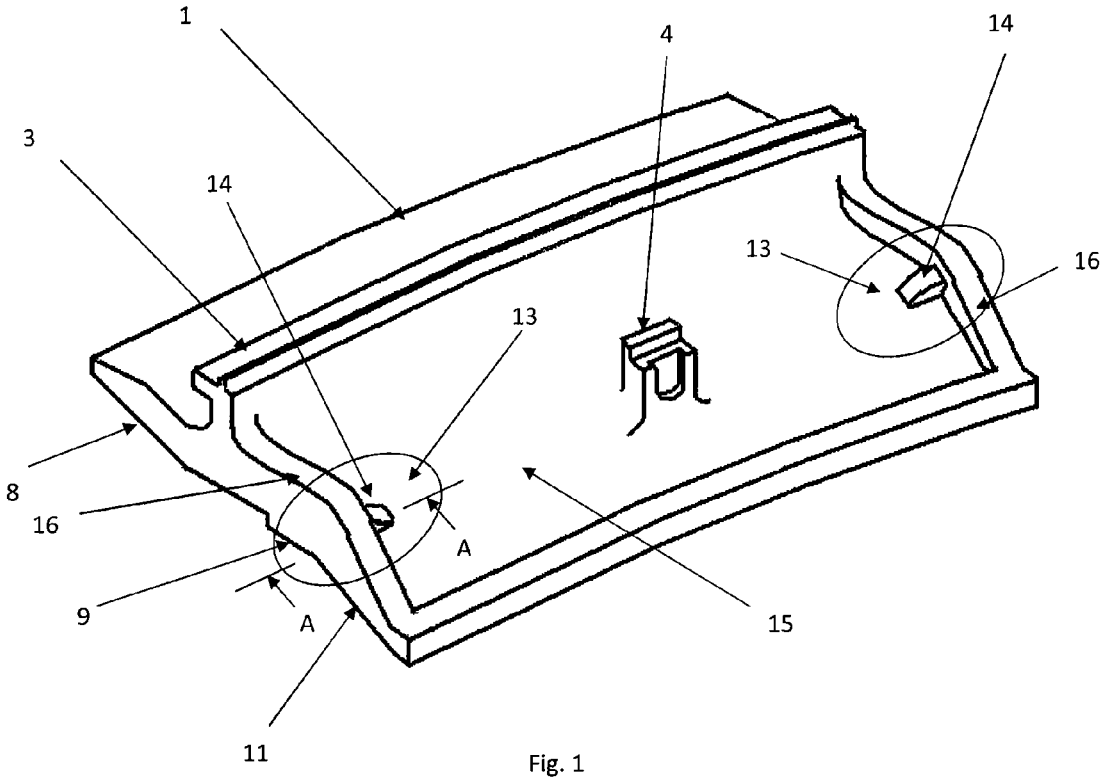
FIG. 1 a perspective view of a heat shield segment according to one embodiment of the invention, FIG. 2 a cross section through the heat shield of FIG. 1 in the area of the boss along the line A-A, FIG. 3 a cross section through a turbine portion with a prior art heat shield segment, FIG. 4 a perspective view of a prior art heat shield segment.

FIG. 1 shows a heat shield segment 1 according to a preferred embodiment of the invention. Similar elements are provided with similar reference numerals. According to the invention a radially outer side 15 of the heat shield segment 1 in the area of the curved section 12 and at least one end area 13 of the heat shield segment 1 in the circumferential direction of the turbine is provided with a boss 14 or a raised portion which extends in the circumferential direction of the turbine. This boss 14 or raised portion reduces the stress concentrations in this region of the heat shield 1. A boss 14 or raised portion can be provided at each end 13 of the heat shield segment 1.

Preferably the boss 14 or raised portion is arranged at a position in the axial direction of the turbine where the first section 9 and the second section 11 meet.

The length of the boss 14 in the circumferential direction is preferably less than a quarter of the total length of the heat shield segment 1 in the circumferential direction. In this way additional metal usage can be kept to a minimum as no rib must be provided extending substantially between the ends of the heat shield segment 1. Therefore the weight of the heat shield segment 1 can be kept low.

Figure 2:
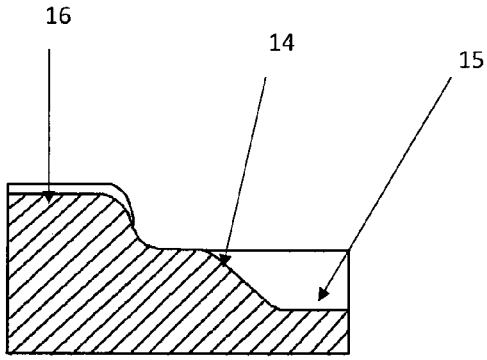

In the preferred embodiment in FIG. 1 the radially outer surface 15 of the heat shield 1 is preferably provided with two ribs 16, which each extend in the axial direction of the turbine at least partially along the circumferential ends of the heat shield segment 1. The boss 14 or raised portion projects out of the respective rib 16 in the circumferential direction. The profile of the heat shield segment 1 in the circumferential direction of the turbine and in the region of the boss 14 can thus have a two stepped form, which can be seen from FIG. 2. Preferably the ratio of the length of the boss in the circumferential direction of the turbine to the width of the boss in the axial direction of the turbine is in the ratio of between 1:2 to 3:1.

The heat shield segment 1, in a further embodiment (not shown), has at least two points in the axial direction of the turbine a curved section i.e. the cross section of the heat shield has a two stepped form. The two stepped form as used herein is essentially a two stepped form. In this case the radially outer side of the heat shield segment is provided with a boss 14 in the respective areas of the curved section and in a first and/or a second end region in the circumferential direction of the heat shield, the respective boss 14 extending in the circumferential direction.

A heat shield can comprise a number of heat shield segments according to the invention which form an outer limit of a hot gas flow along the turbine blades 2 (cf. FIG. 3). The heat shield segments 1 are provided with grooves 17 in their end sides extending in the axial direction of the turbine as can be seen from the FIG. 2. The grooves 17 of two neighboring heat shield segments 1 receiving a sealing plate (not shown) which prevents hot combustion gases from entering the space 18 between the heat shield and the turbine housing 19 filled with cooling air.

The preceding description of the embodiments according to the present invention serves only an illustrative purpose and should not be considered to limit the scope of the invention.

Particularly, in view of the preferred embodiments, the man skilled in the art different changes and modifications in the form and details can be made without departing from the scope of the invention. Accordingly the disclosure of the current invention should not be limiting. The disclosure of the current invention should instead serve to clarify the scope of the invention which is set forth in the following claims.

LIST OF REFERENCES

1 heat shield segment
2 turbine blade
3 attachment element
4 attachment element
5 platform
6 rib
7 honeycomb structure
8 inner profile
9 first section
10 flow direction
11 second section
12 curved area
13 end region
14 boss
15 outer side
16 rib
17 groove
18 space
19 turbine housing

What is claimed is:

1. A gas turbine comprising:

a turbine housing;

a rotatable turbine rotor having a plurality of turbine blades; and at least one heat shield segment for a stator disposed radially between the rotor and the housing and attached to the housing, the at least one heat shield segment having a profile with a curved section in at least one region in an axial direction of the gas turbine and having a radial outer surface and including:

a first boss extending in a circumferential direction of the gas turbine in a region of the curved section and in a first end area in the circumferential direction disposed on the radial outer surface;

a rib disposed at the first end area extending at least partially in a longitudinal direction of the gas turbine, wherein the first boss protrudes from the rib in the circumferential direction disposed on the radial outer surface; and a second boss extending in the circumferential direction in a region of the curved section and in a second area opposite to the first end area disposed on the radial outer surface, wherein the profile includes a two-stepped form in the circumferential direction in an area of the first boss, wherein a first step extends from the radial outer surface to the first boss and a second step extends from the first boss to the rib.

2. The gas turbine as recited in claim 1, wherein a length of the first boss in the circumferential direction is less than a quarter of a total length of the at least one heat shield segment in the circumferential direction.

3. The gas turbine as recited in claim 1, wherein a ratio of a length of the first boss in the circumferential direction to a width of the at least one boss in the axial direction is between 1:2 and 3:1.

4. The gas turbine as recited in claim 1, wherein the profile includes a second curved section in the axial direction, wherein the second curved section includes at least one of another first boss in a first end region in the circumferential direction on the radial outer surface extending in the circumferential direction and another second boss disposed in a second end region in the circumferential direction on the radial outer surface and extending in the circumferential direction.

5. The gas turbine as recited in claim 1, wherein an inner profile of the at least one heat shield segment includes a first section extending parallel to the axial direction and a second section upstream of the first section extending at an angle to the axial direction, wherein the first boss is disposed at a position wherein the first and the second sections meet in the axial direction.

6. The gas turbine as recited in claim 1, wherein the at least one heat shield segment includes a groove disposed in an area of the first boss and in a radially extending side of the at least one heat shield segment and extending in the axial direction.

7. The gas turbine as recited in claim 1, wherein the at least one heat shield segment includes a plurality of heat shield segments forming a heat shield of an outer limit of a hot gas flow along the turbine blades.

8. A heat shield segment for a stator of a gas turbine disposed radially between a turbine rotor and turbine housing and attached to the housing having a profile with a curved section in at least one region in an axial direction of the gas turbine and having a radial outer surface comprising:

a first boss extending in a circumferential direction of the gas turbine in a region of the curved section and in a first end area in the circumferential direction disposed on the radial outer surface of the at least one heat shield segment;

a rib disposed at the first end area extending at least partially in a longitudinal direction of the gas turbine, wherein the first boss protrudes from the rib in the circumferential direction disposed on the radial outer surface; and a second boss extending in the circumferential direction in a region of the curved section and in a second area opposite to the first end area disposed on the, radial outer surface, wherein the profile includes a two-stepped form in the circumferential direction in an area of the first boss, wherein a first step extends from the radial outer surface to the first boss and a second step extends from the at least one boss to the rib.

9. The heat shield segment as recited in claim 8, wherein a length of the first boss in the circumferential direction is less than a quarter of a total length of the heat shield segment in the circumferential direction.

10. The heat shield segment as recited in claim 8, wherein a ratio of a length of the first boss in the circumferential direction to a width of the at least one boss in the axial direction is between 1:2 and 3:1.

11. The heat shield segment as recited in claim 8, wherein the profile includes a second curved section in the axial direction, wherein the second curved section includes at least one of another first boss in a first end region in the circumferential direction on the radial outer surface extending in the circumferential direction and another second boss disposed in a second end region in the circumferential direction on the radial outer surface and extending in the circumferential direction.

12. The heat shield segment as recited in claim 8, wherein the profiled includes an inner profile having a first section extending parallel to the axial direction and a second section upstream of the first section extending at an angle to the axial direction, wherein the first boss is disposed at a position wherein the first and the second sections meet in the axial direction.

13. The heat shield segment as recited in claim 8, further comprising a groove disposed in an area of the first boss and in a radially extending side of the heat shield segment and extending in the axial direction.

14. The heat shield segment as recited in claim 8, wherein the at least one heat shield segment includes a plurality of heat shield segments forming a heat shield of an outer limit of a hot gas flow along the turbine blades.

* * * * *